United States Patent [19]

Duncan

[11] Patent Number: 4,917,525

[45] Date of Patent: Apr. 17, 1990

[54] BAYONET COUPLING CONNECTOR

[75] Inventor: William C. W. Duncan, Northampton, Great Britain

[73] Assignee: AB Electronic Components Limited, Great Britain

[21] Appl. No.: 319,974

[22] Filed: Mar. 7, 1989

[30] Foreign Application Priority Data

Mar. 12, 1988 [GB] United Kingdom ..... 8805912

[51] Int. Cl.[4] ..... B25G 3/00

[52] U.S. Cl. ..... 403/27; 403/349; 285/93

[58] Field of Search ..... 403/349, 27; 285/93, 285/361

[56] References Cited

U.S. PATENT DOCUMENTS 2,450,527 10/1948 Smith et al. ..... 285/361 X 3,287,031 11/1966 Simmons et al. ..... 403/349 X

FOREIGN PATENT DOCUMENTS 2187820 9/1987 United Kingdom ..... 403/349

*Primary Examiner*—Andrew V. Kundrat

*Attorney, Agent, or Firm*—Thomas E. Sisson

[57] ABSTRACT

A bayonet coupling connector having a coupling nut on a first coupling member arranged for cooperation with coupling pins of a second coupling member for enabling the two members to be joined together. The coupling nut carries a coupling ring provided with a spring loaded plunger which is capable of being displaced radially with respect to the nut, the coupling ring being effective for driving the coupling nut when the plunger is engaged therewith. The plunger further being capable of being displaced radially by a coupling pin of the second coupling member when the nut has been moved into a position where the two coupling members are locked together, the locking action thus causing the coupling ring to be suddenly disengaged from the nut thereby providing a tactile indication of the fully locked condition.

The connector is suitable for different applications such as fluid supply lines and electrical connectors and it gives additional safety in reducing a risk of making a faulty connection between the members.

3 Claims, 1 Drawing Sheet

BAYONET COUPLING CONNECTOR

BACKGROUND OF THE INVENTION

This invention relates to a bayonet coupling connector. It relates particularly to a connector which is capable of being separated into two parts with one of the parts carrying a coupling nut, the two parts being capable of being placed in contact with one another and then locked together by a partial rotation of the coupling nut.

Types of bayonet coupling connector can be used in many different applications such as fluid supply lines and electrical connectors. After placing the two halves of the connector together the locking action is effected by rotating the coupling nut through about 120° to effect a bayonet connection between the two connector parts. It is sometimes necessary to have a reliable indication that the two parts have been correctly mated because the manual action of locking the connection does not always produce a positive change in the feel of the movement applied to the coupling nut. In the case where the coupling needs to be secured by a rotation of the coupling nut with a gloved hand there is a risk that the resulting loss in sensitivity will lead to an assumption that the connector has been locked correctly when in fact an error has been made. Adverse conditions, such as noise or lack of space may also cause errors in the locking of the connector.

The present invention was devised to provide a coupling connector which is capable of giving an indication in a positive manner when the coupling nut has been correctly locked.

SUMMARY OF THE INVENTION

According to the invention, there is provided a bayonet coupling connector including a coupling nut on a first coupling part arranged for cooperation with coupling pins of a second coupling part for enabling the two parts to be joined together, in which the said coupling nut carries a coupling ring provided with a spring loaded plunger which is capable of being displaced radially with respect to the nut, the coupling ring being effective for driving the coupling nut when the plunger is engaged therewith, and the said plunger being capable of being displaced radially by a coupling pin of the said second coupling part when the nut has been moved into a position where the two coupling parts are locked together, the locking action thus causing the coupling ring to be suddenly disengaged from the nut thereby providing a tactile indication of the locked condition.

The plunger may comprise a ball capable of being displaced by the said coupling pin when the coupling nut has been moved into the fully locked position.

The plunger may additionally include a marker pin having an end which is capable of being lifted above a surface of the coupling rings when the two coupling parts have been locked. The action of locking the nut will then lift the plunger and cause the marker pin end to project above the coupling ring surface to provide a further indication that can be detected by touch.

For uncoupling the connector, the coupling nut may carry shallow rachet grooves on an outer surface thereof, the said grooves being capable of being engaged by the plunger when the coupling ring is rotated in a direction for unlocking the coupling.

DETAILED DESCRIPTION OF THE PREFERRED EMBODIMENT

By way of example, a preferred embodiment of the invention will now be described with reference to the accompanying drawing.

Figure 1:
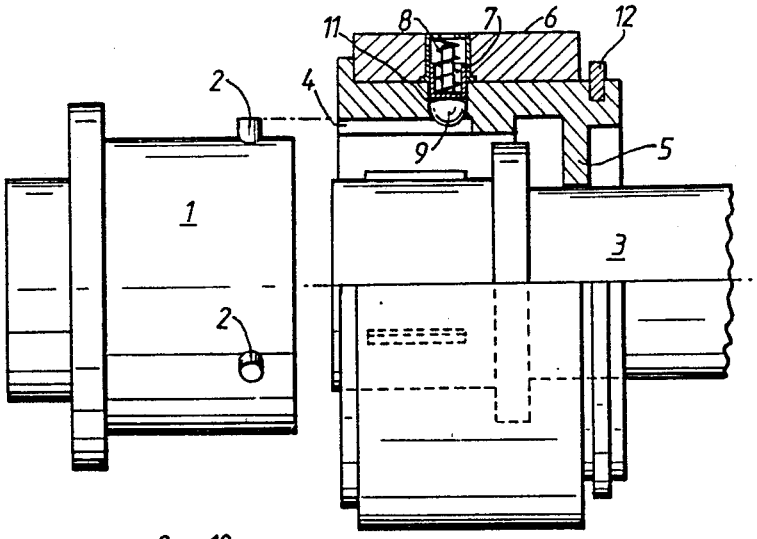
FIG. 1 is a partial cross-sectional view taken along the longitudinal axis showing the two parts of the coupling connector.

As shown inn FIG. 1, the bayonet coupling connector comprises a coupling pin member 1 which carries three coupling pins 2, and a coupling nut member 3. The coupling nut member 3 has a freely rotatable coupling nut 5 and this has internal bayonet tracks 4 which are able to receive the coupling pins 2 of the coupling pin member 1 when the two members of the coupling are required to be mated. Rotation of the nut 5 will then cause the two members to be moved further together until a position is reached when the pins 2 are engaged by a detent in the bayonet tracks and the connector can be said to be locked.

In the embodiment of FIG. 1, the coupling nut 5 carries a coupling ring 6 which is in the shape of a sleeve and which is located concentrically about the nut 5. The coupling ring 6 is provided with a hollow plunger 7 which is urged radially inwards by a spring 8. The inward movement of the plunger 7 is limited by a ball 9 which is movable freely in a radial hole 11, the innermost end of the hole being constricted to prevent loss of the ball 9 from the hole. The coupling ring 6 is retained on the coupling nut 4 by a circlip 12.

Figure 2:
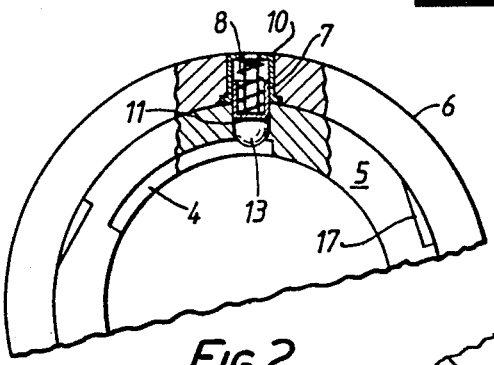
FIG. 2 is a partial cross-sectional view of a second embodiment taken on the transverse axis of the coupling nut part of the connector, showing the plunger positioned to lock the ring to the nut.
Figure 3:
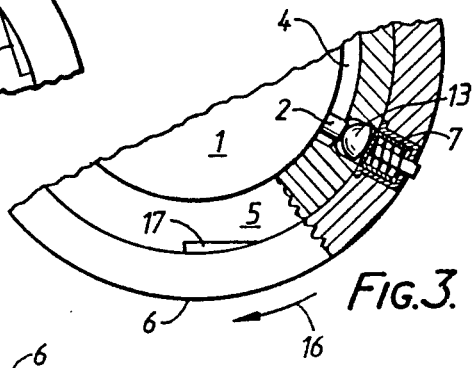
FIG. 3 is similar to FIG. 2, but shows a coupling pin lifting the plunger to permit free movement of the ring about the nut.

FIGS. 2 and 3 show a second embodiment in which the plunger 7 and spring 8 have been accommodated in a mounting cage 10 which is set into a suitable socket formed in the material of the coupling ring 6. In this embodiment, the ball 9 has been replaced by a ball-ended spacer 13. As shown in the partial cross-sectional view of FIG. 2, the hollow plunger 7 has moved the ball-ended spacer 13 down in the hole 11 of the nut 5 so the spacer 13 partially enters one of the bayonet tracks 4 of the nut. In doing this, the plunger 7 acts to lock the coupling ring 6 and the nut 5 together so that any rotation of the coupling ring 6 will be applied equally to the nut 5.

FIG. 3 shows the situation where the nut 5 has been fully locked onto the coupling pins 2 of the coupling pin member 1 and one of the coupling pins 2 has acted to lift the ball-ended spacer 13 at the end of its movement along the bayonet track 4. When the ball-ended spacer 13 is lifted in this way, the plunger 7 is raised sufficiently for it to be freed from the hole 11 of the nut 5. The coupling ring 6 and nut 5 are then no longer locked together and the ring 6 becomes suddenly freely rotatable without it having any effect on the movement of the nut 5.

Figure 4:
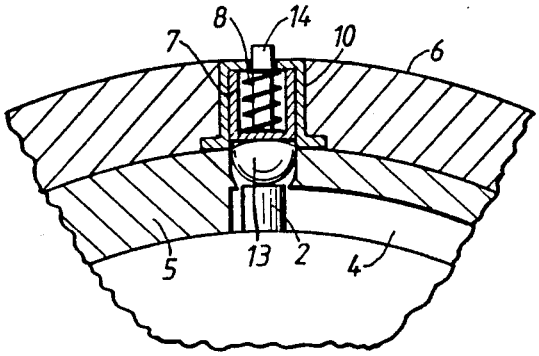
FIG. 4 is a detail drawing of a different embodiment showing the plunger being lifted by a coupling pin and where a marker pin has been provided.

FIG. 4 depicts a detail of a different embodiment showing the plunger 7 and spring 8 in the mounting cage 10. The coupling pin 2 is shown as having lifted the ball-ended spacer 13 and this has raised the lower surface of the plunger 7 so it lies flush with the inner wall of the coupling ring 6. The base of the plunger 7 carries a marker pin having an end 14 which in this position is raised up above the outer wall of the coupling ring 6. This protrusion of the marker pin end 14 above the wall of the ring 6 is an additional indication of the coupling being in the locked condition and this can be easily detected by touch.

In operation of the connector, when the two members have been brought together and the coupling pins 2 engaged in the bayonet tracks 4 of the coupling nut 5, the nut 5 can be turned by movement of the coupling ring 6 carried on the outer surface of the nut 5. The coupling ring 6 will be able to drive the coupling nut 5 because the plunger 7 of the ring is able to partially enter the hole 11 of the nut 5. At this point, the ball 9 has been able to be pushed downwards to the inner end of the hole 11 so there is room above the ball for the plunger 7 to enter the hole. The ball 9, in fact, partially extends beyond the inner end of the hole 11 into on of the bayonet tracks 4 of the nut.

With continued rotation of the coupling nut 5, the coupling pins 2 move along the bayonet tracks 4 of the nut while the two members of the coupling are brought further together. When the pins 2 reach the ends of the bayonet tracks 4, the connector has reached its locked state. In this position, one of the pins 2 has served to push outwards the ball 9 within the hole 11 so that the plunger 7 is moved completely outside the hole 11. The coupling rings 6 therefore becomes suddenly freely rotatable and no further movement of the ring will cause an additional rotation of the nut 5.

As the pin 2 reaches the end of the bayonet track 4 the pin acts to lift the ball 9 within the hole 11 against spring pressure. This action thus serves to give a little further resistance to the movement of the nut 5 about the pin 2, but to the user, the main indication that the locking action is complete will be the sudden free rotation of the coupling ring 6 that then becomes possible. This tactile indication will therefore be easily detected by a gloved hand or in dark or noisy surroundings and it will be a positive signal that correct mating of the connector members has been effected.

In order to unlock the coupling connector, the coupling ring 6 must be rotated in the opposite sense to that used to lock the connector. That is, in the direction 16 as shown in FIG. 3. To effect uncoupling, the coupling nut 5 is provided with three ratchet grooves 17 which are able to be engaged by the ball-ended spacer 13 only when the ring 6 is rotated in the direction for uncoupling. Thus, for uncoupling, the coupling ring 6 is able to turn the nut 5 and the pins 2 ar able to be pushed along the internal bayonet tracks 4 of the nut to allow the two members of the connector to be separated.

The foregoing description of an embodiment of the invention has been given by way of example only and a number of modifications may be made without departing from the scope of the invention as defined in the appended claims. For example, it is not essential that the coupling ring 6 should be provided with only a single spring-loaded plunger. In a different embodiment, the number of plungers might be two or three. In alternative embodiments, the numbers of coupling pins 2 o ratchet grooves 17 might be varied from the numbers specifically described.

I claim:

1. A bayonet coupling connector comprising:

a first coupling member having radially protruding pins;

a second member further comprising:

a rotatable coupling nut having internal tracks for receiving said pins when said first and second members are mated, said members being rotatable relative to each other to move said pins around and to the ends of their respective tracks to fully lock said members together;

a coupling ring which slidingly surrounds said coupling nut;

a spring biased plunger supported by said coupling ring and extending radially to rotationally lock said ring to said nut; and an operative part of said plunger which extends into a respective track, said operative part radially displacable by said respective pin whenever said first and second members are fully locked together, said respective pin bearing against and urging said plunger radially outward to rotationally disengage said nut from said coupling ring and allow said coupling ring to rotate freely around said nut in a first direction whenever said first and second members are fully locked together.

2. A bayonet coupling connector according to claim 1, wherein said plunger partially protrudes out of an external peripheral surface of said coupling ring whenever said nut is rotationally disengaged from said ring.

3. A bayonet coupling connector according to claim 1, wherein said nut further comprises shallow ratchet grooves formed on the outer surface of said nut to rotationally engage respective plungers during opposite direction rotation of said ring to unlock said first and second members.

* * * * *